US005173588A

United States Patent [19]

Harrah

[11] Patent Number: 5,173,588

[45] Date of Patent: Dec. 22, 1992

[54] FOOD CONSUMPTION MONITOR

[76] Inventor: Shane Harrah, 1100 Sharon Park Dr. (#27), Menlo Park, Calif. 94025

[21] Appl. No.: 588,585

[22] Filed: Sep. 25, 1990

[51] Int. Cl.[5] ..... G06C 27/00

[52] U.S. Cl. ..... 235/114; 235/119

[58] Field of Search ..... 235/1 B, 1 C, 65, 88 R, 235/89 R, 83, 117 R, 119, 121, 122, 131 JA, 114

[56] References Cited

U.S. PATENT DOCUMENTS

| | | | |
|---|---|---|---|
| 2,564,450 | 8/1951 | Rupp | 235/114 |
| 3,160,345 | 12/1964 | Walsh | 235/78 |
| 3,212,708 | 10/1965 | Nutting et al. | 235/114 |
| 3,282,499 | 11/1966 | Zentarra | 235/65 |
| 4,721,309 | 1/1988 | Miesel | 235/88 G |

*Primary Examiner*—Donald A. Griffin
*Assistant Examiner*—Eddie C. Lee

[57] ABSTRACT

Food consumption monitor comprising a simple mechanical calculator integrated into a diet guidebook. The calculator includes a manually operable rotary dial with a scale pointer on it, a base for the dial, a means for rotatably mounting the dial to the base, a finger stop attached to the base near the dial, and a set of numerals which are printed in consecutive order on the base near the dial and which are equidistant from the dial's rotary axis. The dial has a set of finger holes or dimples which are equidistant from the dial's rotary axis. The dial's scale pointer is a visually distinctive feature on the dial, such as an annular rim around one of the holes, which rotates with the dial in close proximity to the set of numerals. The base includes a molded plastic casing which partially encloses the dial. This casing includes an axle, a stationary hub, and a support arm for rigidly coupling the hub to a wall of the casing, wherein these three components are the means for rotatably mounting the dial. The calculator's plastic casing is attached to the interior face of the guidebook's hardbound cover. This diet guidebook includes data related to some food parameter, such as grams of fat. The user registers his consumption of this parameter by rotating the dial by an amount specified in the guidebook.

27 Claims, 3 Drawing Sheets

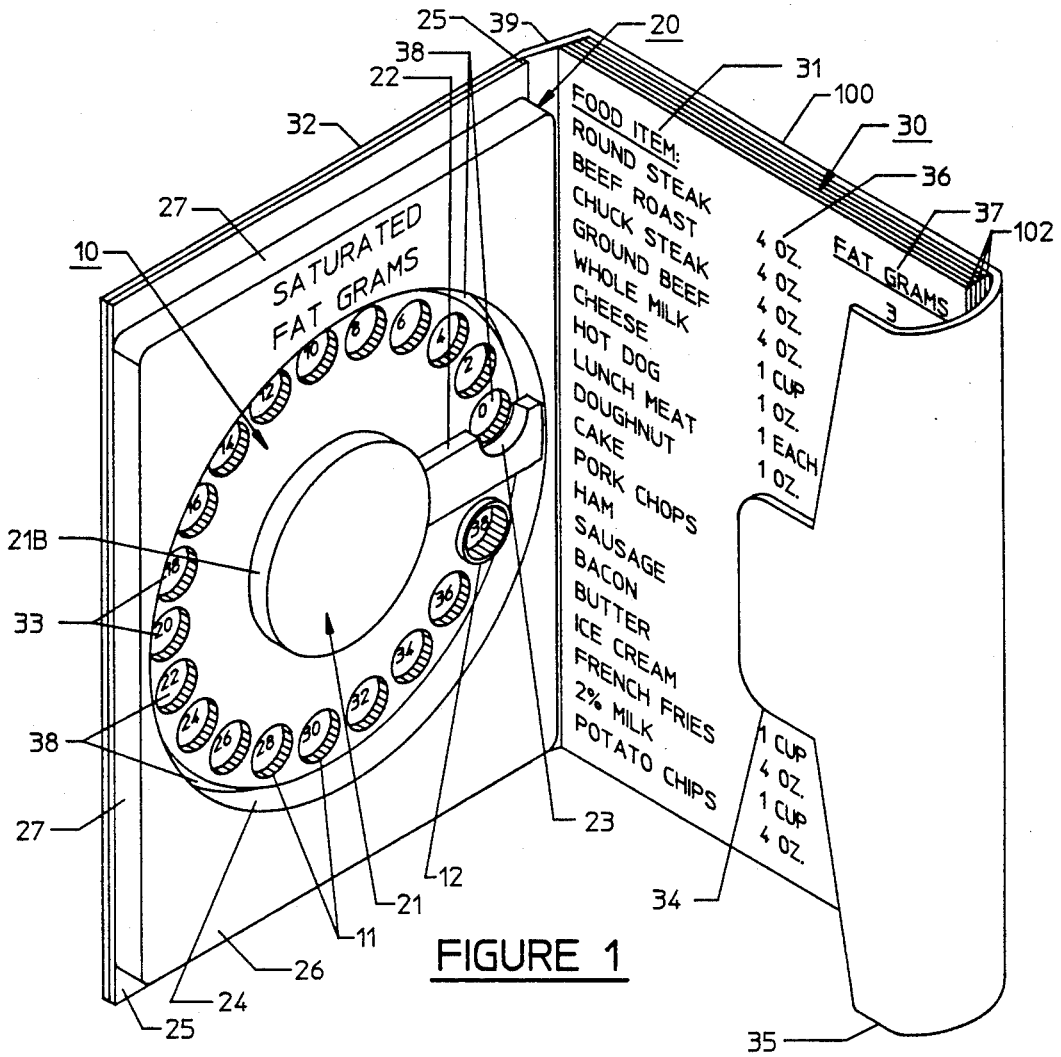
FIGURE 1
FIGURE 2
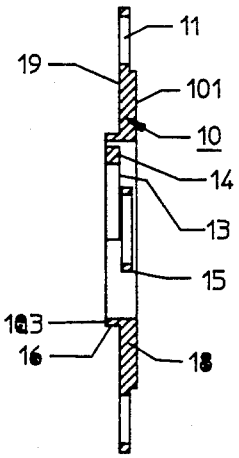
FIGURE 3
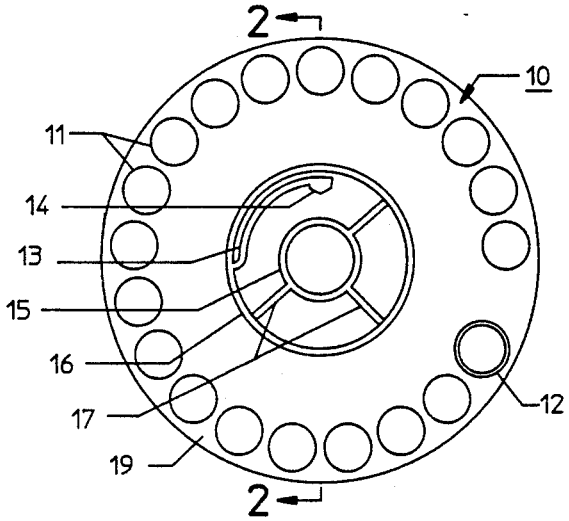
FIGURE 4
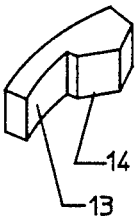

FIGURE 13
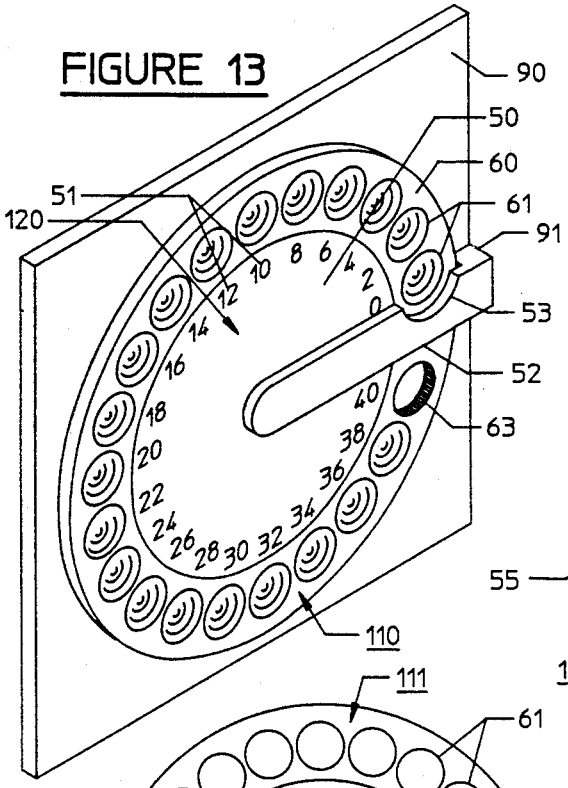
FIGURE 14
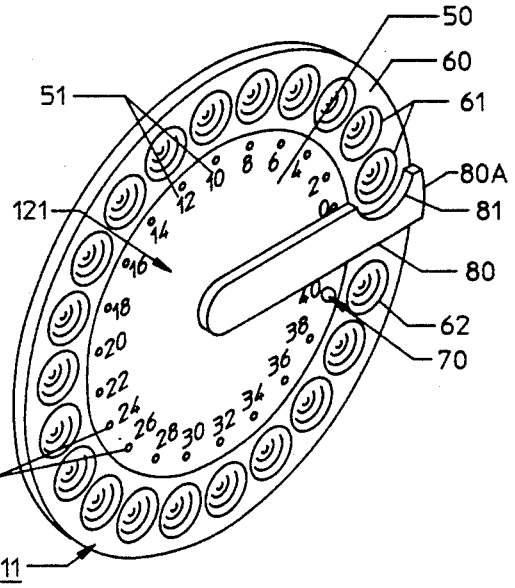
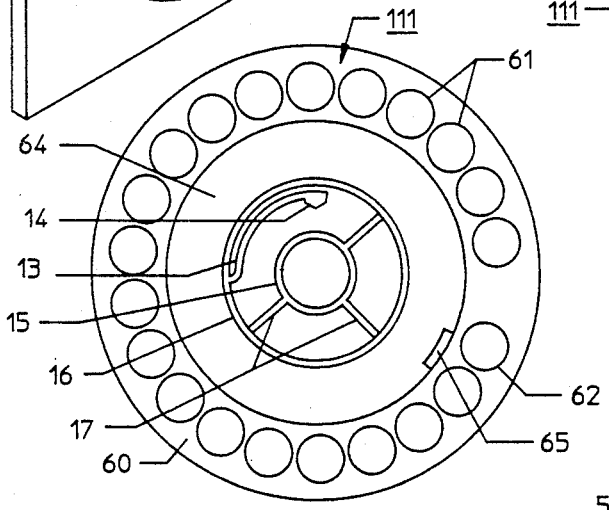
FIGURE 15
FIGURE 16
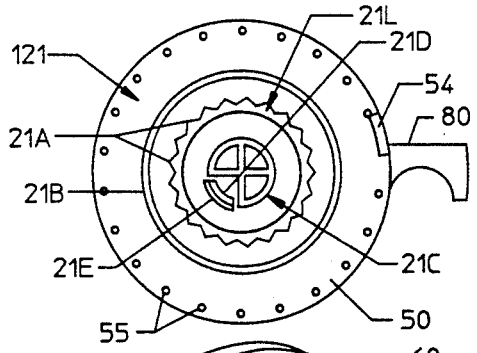
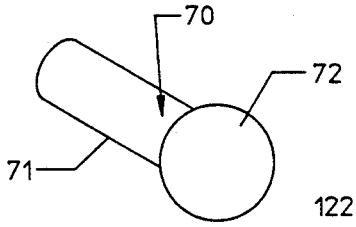
FIGURE 17
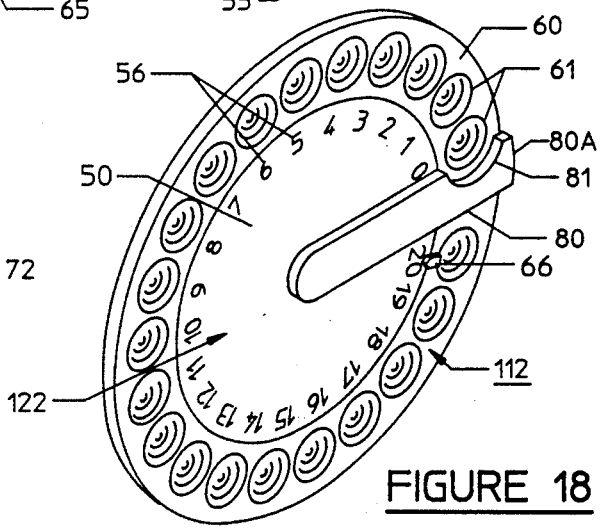
FIGURE 18

FOOD CONSUMPTION MONITOR

BACKGROUND OF THE INVENTION

1. Field Of The Invention

The present invention relates to simple, manually operable mechanical registers. More specifically, the present invention relates to registers for monitoring consumption of food and for indicating when the cumulative consumption of food has reached a preset maximum or minimum limit.

In developed nations such as the United States, a significant percentage of the population eats excessive quantities of food, which often causes health problems. Many people become obese by consuming more calories of food than their bodies require for ideal weight maintenance. Similarly, many people develop elevated serum cholesterol levels by consuming excessive quantities of saturated fats in their diets. Other health problems are caused by excessive sodium or insufficient fiber in the diet. People are becoming better educated now about the health risks of poor diets, so many people are trying to improve their diets with the help of diet books and dieting products. Although the best diet books teach the principles of healthy diets for controlling weight or serum cholesterol, some people have trouble adhering to these diets because monitoring one's food consumption during the day can be relatively difficult. Counting calories or grams of fat consumed can be tedious, so a variety of products have been developed to help dieters monitor their food consumption. None of the other products is completely satisfactory, however.

2. Prior Art

In Thomann's U.S. Pat. No. 4,310,316, a diet control apparatus is described for monitoring consumption of foods in each of the primary food groups in order to insure that the user eats a balanced diet. This diet control means includes a plurality of symbolic food tokens with each such token bearing thereon a selected particular food group designation. These tokens are arranged into selected groups of tokens with each such group comprising the number of tokens prescribed for a particular designated meal. The dieter redeems a token (or tokens) for a specific food item (or items) within the particular food group designation as identified in an accompanying chart of food groups and food items, whereby the dieter can register his consumption of foods. At the end of the day all tokens are replaced into the same selected groups of tokens for use in the same manner during the following day.

Tilney's U.S. Pat. No. 4,828,498 discloses a food exchanges kit which is similar in intent to Thomann's diet control apparatus. This kit includes color coordinated food exchange cards to match foods of the primary food groups in a food exchange list. Self-adhesive labels printed with various meal designations are provided for affixing to the food exchange cards. Each card represents one food exchange and is color coordinated to match the colors of the various food groups found in the American Diabetic Association booklet entitled "Exchange Lists For Meal Planning". These cards are used by a dieter in a manner similar to the food tokens disclosed in Thomann's patent.

Basil's U.S. Pat. No. 4,832,603 discloses a daily food consumption planner which is also similar in intent to Thomann's diet control apparatus. This planner comprises a display panel and movable symbolic food tokens mounted upon this display panel. The display panel has seven food group display zones across the top of the panel and six meal display zones across the bottom. The meal display zones are each divided into three parallel columnar zones, one of which contains a list of all the food groups, the second of which is adapted to receive a numerical designation of the prescribed number of food units of each group to be consumed during each meal, and the third of which is adapted to receive movable tokens indicative of food choices and food portions within each food group. The movable tokens are mounted within each food group zone. Displayed on each of the movable tokens is a quantity and choice of food which constitutes one unit of food of a food group. The food tokens are movable from the food group zone to the third column of the meal zone, in the prescribed numbers displayed in the second column of the meal zone, so as to display the choice of selected foods for each meal and the quantities of those choices.

Although Thomann's patent, Tilney's patent, and Basil's patent all disclose inventions which help people monitor their consumption of foods in each basic food group in order to insure a reasonably balanced diet, none of these inventions is particularly well suited for accurately monitoring a specific constituent of foods such as saturated fat. Unlike these other inventions, the present invention is specially designed for monitoring such a food constituent, which is important for alleviating some health problems such as elevated serum cholesterol. Another disadvantage of these other inventions is that each of them comprises tokens or cards which can be lost relatively easily, whereas the present invention does not include components which can be lost easily. An advantage of the present invention, when compared to these prior art inventions, is that many people prefer using a simple rotary dial register to a system of cards or tokens.

Schafer's U.S. Pat. No. D.267,238 discloses an ornamental design for a carbohydrate-calorie recorder which comprises a dial for registering calorie or carbohydrate consumption. Unlike the present invention, Schafer's design does not include any structural provisions for incorporating the dial register into a diet guidebook; this dial register's form is not readily suitable, as is, for mounting it inside a diet guidebook. One advantage of the present invention is that the dial register is an integral part of a pocket-sized diet book so that the invention is both convenient and very informative. This book is a protective enclosure for the dial register.

Walden R. Williams wrote a pocketbook, copyrighted in 1935, entitled "Vest Pocket Calorie Counter" which incorporates a simple dial register for monitoring calorie consumption. This dial register comprises a thin rotary dial rotatably mounted, with a grommet, to the interior side of the book's front cover. The dial has an annular row of numerals printed on it in consecutive order near the dial's perimeter. The book's front cover has a small opening/window through which one of the dial's numerals is visible. The numeral which is visible in this window represents the dieter's cumulative calorie consumption during the day. The perimeter of this dial is serrated and a portion of it extends beyond the edge of the book's cover so that the dial can be manually rotated when the book is closed. In order to register the consumption of a particular quantity of calories, the dieter must mentally add this quantity to the quantity which is visible in the cover's window, and then the dieter rotates the dial until the new sum is visible through the window. The dieter must remember his daily calorie consumption limit so that he stops eating once this limit equals the numeral visible through the window. Unlike Williams' calorie counter, the present invention performs all calculations for the dieter and it indicates what his daily limit is.

Single axis rotary disk registers which have an annular row of numerals on the face of a manually operable rotary dial, such as Williams' calorie counter, typically cannot do successive subtraction operations which the present invention can do. The present invention can do successive subtraction because its annular row of consecutively ordered numerals is printed on a non-rotating component and because its dial has a scale pointer attached which rotates with the dial in close proximity to the annular row of numerals. The scale pointer indicates the result of each subtraction operation. The present invention's dial has an annular row of finger holes or dimples. A user can subtract a a numeral in the annular row of numerals by placing his index finger tip into the dial's hole or dimple which is nearest to that numeral and then rotating the dial until that hole or dimple is nearest to the numeral 0 in the annular row of numerals. The present invention includes a stationary finger stop operatively associated with the dial for blocking the rotary movement of the user's index finger tip in that hole or dimple once that hole or dimple is nearest to the numeral 0. This feature prevents the user from rotating the dial too far during a subtraction operation. A preferred embodiment of the present invention includes a movable peg which can be mounted adjacent to any one of the numerals in the annular row of numerals, for indicating the user's prescribed daily cummulative limit of some food constituent, such as saturated fat. Thus, the user does not need to memorize this limit. The unique configuration of the present invention's components allows it to perform functions which other simple, single axis disk registers cannot perform.

Nutting and Stubbmann's U.S. Pat. No. 3,212,708 discloses a digital input manually operable toy computer with a rotary dial, a finger stop, a casing, an annular row of numerals around the dial, a two digit mechanical display, and a multiple component mechanism for mechanically coupling the display to the rotary dial such that this apparatus can perform addition and subtraction operations. This multiple component mechanism, the dial, and two digit display together constitute a set of moving parts in a configuration which is much more complex than the present invention's structure. The present invention's unique configuration of components can perform addition or subtraction with fewer moving parts than prior art mechanical calulators, such as Nutting and Stubbmann's toy computer, so the present invention is less expensive to manufacture.

SUMMARY OF THE INVENTION

The present invention provides a simple mechanical calculator and guidebook for monitoring consumption of some food parameter. The calculator comprises a manually operable rotary dial with a scale pointer on it, a base for the dial, a means for rotatably mounting the dial to the base, a finger stop rigidly attached to the base near the dial, and a set of numerals which are printed in consecutive order on the base near the dial and which are equidistant from the dial's axis of rotation. The dial has a surface with an annular row of finger holes or dimples which are equidistant from the dial's axis of rotation. Each of these holes or dimples is suitable for manual rotation of the dial with one's fingertip. The dial functions as a simple means for manually inputing numeric data. The scale pointer is a visually distinctive feature on the dial, such as an annular rim around one of the finger holes or such as a distinctively colored dot in one of the dimples. This scale pointer rotates with the dial in close proximity to the set of numerals on the base, wherein this scale pointer highlights whichever numeral is nearest to it. The set of numerals functions as a display scale and this scale in combination with the scale pointer functions as a simple numeric display for the calculator. The base includes a molded plastic casing which partially encloses the dial. This casing has a suitably large opening wherein a person's finger can access the dial's finger holes or dimples for manually rotating the dial. The means for rotatably mounting the dial comprises an axle, a stationary hub, and a support arm for rigidly coupling the hub to a wall of the plastic casing, and this means for rotatably mounting the dial is an integral part of the casing. The plastic casing is mounted onto the interior face of the guidebook's hardbound cover, and this book cover in combination with the plastic casing is the dial's base. The book encloses the dial and plastic casing when the book is closed and thereby is a housing for the register. The set of numerals may be printed either on the hub or on the interior face of the guidebook's cover, near the dial's finger holes or dimples. These numerals represent quantities of some food parameter being monitored, such as grams of saturated fat. The diet guidebook describes how to operate the calculator, and this guidebook includes food data, such as the number of saturated fat grams in different foods. A person registers such data in the calculator by dialing the appropriate quantity specified in the book each time he consumes a food. The scale pointer indicates that the person's cumulative consumption of the relevant food parameter has reached a preset limit when the scale pointer is nearest to the numeral 0.

It is an object of the present invention to provide a simple mechanical calculator for registering a person's consumption of food and for indicating when the person's cumulative food consumption has reached a preset maximum or minimum limit.

Another object of the present invention is to provide a simple mechanical calculator, for successive addition or subtraction of numbers, which consists of very few separate molded plastic parts.

Another object of the present invention is to provide a food monitor calculator in combination with a diet guidebook which together help a person limit his consumption of foods containing some unhealthy constituent, such as saturated fat or sodium.

Another object of the present invention is to provide a simple mechanical calculator in combination with an instruction book for the calculator wherein the book provides a housing for the calculator.

Other objects, advantages, and features of the present invention will become apparent from the following detailed description of this invention's various embodiments.

BRIEF DESCRIPTION OF FIGURES

FIG. 1 shows a perspective view of the first embodiment of the food consumption register, including rotary dial 10 and plastic casing 20, mounted inside a diet guidebook 30.

FIG. 2 shows a cross sectional side view of the rotary dial's embodiment which is shown in FIG. 3, where the section is taken on line 2—2.

FIG. 3 shows a front view of the first embodiment of the register's rotary dial (dial 10).

FIG. 4 shows an enlarged perspective view of pawl tooth 14 and a portion of pawl arm 13, which together constitute the first embodiment of a pawl attached to the dial.

FIG. 13 shows a perspective front view of another embodiment of a register comprising a rotary dial 110, a hub 120 with numerals 51 printed on the hub's front face, an arm 52, and a base plate 90.

FIG. 14 shows a perspective front view of the prefered embodiment of the dial, the hub, and the arm attached to the hub.

FIG. 15 shows a front view of the prefered embodiment of the dial (dial 111) Which is also shown in FIG. 11 and FIG. 14.

FIG. 16 shows a rear view of the prefered embodiment of the hub, arm, axle, ratchet wheel, and a rotary stop, which are also shown in FIG. 12.

FIG. 17 shows an enlarged perspective view of a movable peg 70.

FIG. 18 shows a perspective front view of another embodiment of a dial, a hub, and an arm attached to the hub.

DETAILED DESCRIPTION OF VARIOUS EMBODIMENTS

Figure 5:
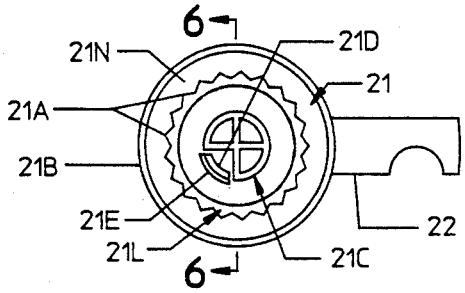
FIG. 5 shows a rear view of the register's hub 21, axle 21C, arm 22, and the first embodiment of a ratchet wheel (ratchet wheel 21L) which is integrated into the hub.

Structure Of Various Embodiments:

As shown in FIG. 1, the first embodiment of the present invention includes a diet guidebook 30 having a hardbound front cover 32 with a flat interior surface 38 on which a manually operable rotary dial/disk 10 is rotatably mounted. This cover 32 is a substantially rigid book component with the dial's axis of rotation substantially perpendicular to the cover's interior surface 38, whereby the cover 32 is a base plate for the dial 10 and the cover's surface 38 is a base surface. The dial's axis of rotation is in the center of the dial 10, similar to a telephone dial's axis. The dial's flat rear surface/face 101 and the book cover's interior surface 38 are contiguous and virtually coplanar, whereby the dial's surface 101 slides on the cover's surface 38 during rotation of dial 10. The cover's surface 38 has a set of figures/numerals 33 printed thereon, wherein these numerals 33 represent numbers in the mathematical sequence of consecutive even integers between 0 and 38 inclusive. Thus the mathematical difference between every pair of adjacent consecutive numerals 33 is the number 2. These numerals 33 are disposed on the front cover's surface 38 equidistant from the axis of rotation of dial 10 and equiangularly spaced around this axis in consecutive order on an invisible common circumference. Each numeral 33 represents a number which is proportional to the distance along this circumference from the respective numeral to an origin on this circumference. The numeral "0" is disposed on this origin. The dial 10 has a manipulable front surface/face 19 with twenty finger holes 11 operatively configured for finger rotation of dial 10. These finger holes' common diameter is between 0.3" and 0.7", whereby each hole 11 is a suitable size for a finger hold. The axes of these finger holes 11 are equidistant from the axis of rotation of dial 10 and these holes 11 are equi-angularly spaced around the dial's axis. The distance from the dial's axis to each hole's axis is equal to the distance from the dial's axis to each numeral 33, and the radial angle between adjacent holes 11 is equal to the radial angle between adjacent numerals 33, whereby the holes 11 can be aligned directly in front of the numerals 33 when the dial 10 is in certain rotary positions, as shown in FIG. 1. The radial angle between adjacent finger holes 11 is approximately 17.1 degrees in the embodiment shown in FIG. 1 and FIG. 3. One of the dial's finger holes is distinguished by the presence of an annular rim 12 around the hole. This annular rim 12 protrudes perpendicularly from the dial's surface/face 19, coaxial with one of the finger holes. Whenever the dial's finger holes 11 are positioned directly in front of the numerals 33, the annular rim 12 is in close proximity to (less than 0.200" from) one of the numerals 33, and each finger hole 11 in dial surface 19 is in close proximity to (less than 0.200" from) one of these numerals 33. This annular rim 12 is a visually distinctive element/feature on the dial 10. Rim 12 functions as a scale pointer: it is a means for highlighting whichever numeral 33 is visible behind rim 12. The particular numeral which is highlighted by annular rim 12 depends upon the rotary position of dial 10, because rim 12, whereby it is pointer for a radially disposed numeric scale rotates with dial 10. As shown in FIG. 1, "38" is visible behind the annular rim 12, for example. An injection molded plastic casing 20, with mounting flanges 25 protruding perpendicularly from the casing's perimeter wall 27, is mounted onto the book cover 32. The casing's flanges 25 have an adhesive on their rear side for attaching casing 20 to the cover's interior surface 38. This molded plastic casing 20 includes a hub 21 and a finger stop/-support arm 22. This support arm 22 has a semicircular notch 23, and this notched portion of the arm 22 functions as a finger stop operatively associated with rotary dial 10. The diameter of notch 23 is between 5% and 25% larger than the diameter of each finger hole 11. The distance from the axis of rotation of dial 10 to the center of this notch 23 is equal to the distance from the dial's axis to the axis of any finger hole 11. Arm 22 extends in front of dial 10, disposed parallel to the dial's front surface/face 19 and in close proximity to (less than 0.100" from) this face 19. The arm's notch 23 is disposed in close proximity to (less than 0.200" from) the numeral "0", which represents the first, mathematically smallest number in the mathematical sequence of numerals 33. This numeral "0" is disposed closer to the arm's notch 23 than any of the other numerals 33 on the cover's surface 38. One end of the support arm 22 is rigidly attached to an annular wall 24 of casing 20, and the other end of the support arm 22 is rigidly attached to the hub's annular wall 21B. This support arm 22 retains the hub 21 in a fixed, stationary, nonrotating position. The plastic casing 20, including the hub 21 and the support arm 22, and book cover 32 together constitute a base for dial 10. The dial 10 is disposed substantially in the interior of this base: the dial's body 18 is disposed behind the hub 21 and behind the plane of the casing's front wall/face 26, and the dial's body 18 is disposed in front of the cover's interior surface 38 within an opening in casing 20 created by the casing's annular wall 24, as shown in FIG. 1. This opening in casing 20 is suitably large for permitting finger access to the dial's finger holes 11 and for permitting finger rotation of the dial 10: the dial 10 is between 3" and 6" in diameter, and the opening created by annular wall 24 is larger in diameter than dial 10. The hub 21, the dial 10 and the casing's annular wall 24 are all coaxial, with a gap of 0.010"–0.100" between the perimeter of dial 10 and the casing's annular wall 24, and their common axis is substantially perpendicular to cover 32. It should be noted that casing 20 has a hollow area behind the casing's front wall/face 26, between the annular wall 24 and the perimeter wall 27. The rotary dial 10, the plastic casing 20 (including hub 21 and finger stop/support arm 22), the book's front cover 32, and the set of numerals 33 printed on cover 32 together constitute a unique rotary dial register.

The prefered embodiment of diet guidebook 30 includes information useful for operating the rotary dial register, as shown in FIG. 1. This information includes food data comprising a columnar list of food item descriptions and a columnar list 37 of numerical values of a food parameter. These lists are printed on at least one of the diet guidebook's pages 102. The list of food item descriptions comprises a columnar list 31 of qualitative food item descriptions and a columnar list 36 of food item quantities, wherein a quantity of each food item is listed adjacent to a qualitative description of the food item. In the embodiment shown in FIG. 1, the food parameter of list 37 is saturated fat grams. The approximate numerical value of this parameter associated with each particular food item description is listed adjacent to the particular food item description, on the same horizontal line as the particular food item description, in columnar list 37. For example, the numeral "3" is printed in list 37, adjacent to the food item description "ROUND STEAK 4 OZ.", since 4 ounces of round steak contains approximately 3 grams of saturated fat. The set of numerals 33 which are printed on the book's cover 32 represents sequential values of the food parameter of list 37, whereby a user of the present invention can monitor his consumption of this food parameter while he eats by manually rotating the dial 10 by appropriate amounts specified in list 37. Other pages 102 in the book 30 include printed instructions for operating the rotary dial register. It should be noted that the diet guidebook 30 and the rotary dial register in the first embodiment are operatively associated, since a component of the book 30 is a constituent of the dial register's base and since the book 30 includes information useful for operating the dial register.

The prefered embodiment of the diet guidebook 30 includes the typical components of conventional hardbound books. The guidebook 30 includes a hardbound rear cover 100, a plurality of printed pages 102, a spine/backbone 39, and the hardbound front cover 32, as shown in FIG. 1. These components are bound together via conventional bookbinding technology. When the book 30 is in its closed position (not shown), the rotary dial register is completely enclosed within the book 30, whereby the book 30 and casing 20 provide a protective housing for dial 10. When book 30 is in an open position with its front cover 32 positioned as shown in FIG. 1, the numerals 33 and the dial's finger holes 11 and the annular rim 12 around one finger hole are all externally viewable simultaneously, and a finger can access the finger holes 11 for manual rotation of dial 10.

The first embodiment of the present invention also comprises several optional features. The diet guidebook 30 includes a flexible extension 35 of the book's rear cover 100, with a flap 34 extending from the side edge of this flexible extension of the book's cover, as shown in FIG. 1. The rear cover's flexible extension 35 can be folded around the right hand edge of the book's front cover 32 when the book 30 is closed (not shown). The flap 34 has a snap (not shown) permanently attached to its rear face, which can engage a mating snap (not shown) permanently attached to the exterior surface of the book's front cover 32 when book 30 is closed. These snaps can retain the book 30 in a closed position when the book 30 is not in use.

The first embodiment of the rotary dial 10 consists of a an integrated group of subcomponents which are injection molded as a single plastic piecepart, as shown in FIG. 2 and FIG. 3. Dial 10 includes a simple annular bearing 15, an annular wall 16 which protrudes perpendicularly from the dial's front surface/face 19, and ribs 17 which extend radially from the annular bearing 15 to the dial's body 18. The annular bearing 15 and the annular wall 16 are both coaxial with the dial's axis of rotation, concentric with the perimeter of dial 10. The ribs 17 are rigidly attached to both the dial's body 18 and the annular bearing 15. Bearing 15 is simply an annulus which rotates with the dial 10. Dial 10 also includes a pawl/detent, which consists of a pawl tooth 14 attached to the free end of a curved, flexible pawl arm 13. The opposite end of pawl arm 13 is attached to the annular wall 16, and this pawl arm 13 is disposed such that its arc is substantially coaxial with the axis of rotation of dial 10, with the pawl tooth 14 facing this axis, as shown in FIG. 3. The flexible pawl arm 13 functions as a leaf spring, whereby the pawl is springably attached to the annular wall 16 of dial 10.

Figure 6:
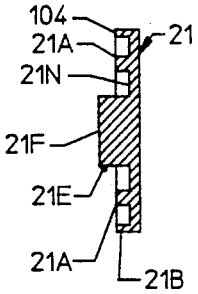
FIG. 6 shows a cross sectional side view of hub 21 and axle 21C, where the section is taken on line 6—6 of FIG. 5.
Figure 7:
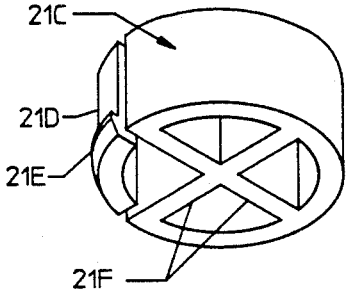
FIG. 7 shows an enlarged perspective view of the axle 21C.

The first embodiment of casing 20, including hub 21 and the hub's support arm 22, consists of an integrated group of subcomponents which are molded as a single plastic piecepart. The hub 21, arm 22, and a stationary axle 21C rigidly attached to hub 21 together constitute a means for rotatably mounting the dial 10 to the dial's base, whereby the means for rotatably mounting the dial 10 is integrated into the casing 20. The stationary axle 21C protrudes perpendicularly from the hub's front disk 21N, as shown in FIG. 5, FIG. 6, and FIG. 7. This stationary axle 21C fits inside the dial's annular bearing 15, coaxial with this bearing 15. There is a gap of approximately 0.002" between the exterior of axle 21C and the interior of bearing 15, whereby the stationary axle 21C permits rotation of the dial's bearing 15 but prohibits lateral movement of the bearing 15 relative the axle's stationary position. Thus the dial 10 can rotate with its axis of rotation retained in a stationary position relative to the dial's base. This stationary axle 21C is a tubular subcomponent with a plurality of radially disposed internal ribs 21F attached for extra strength and rigidity. This axle 21C includes one semi-flexible axle quadrant 21D, which is rigidly attached at one end to the hub's front disk 21N and which is separated from the rib-reinforced portion of the axle 21C by small gaps. The axle quadrant 21D has a beveled rim 21E externally disposed on its free end, as shown in FIG. 7. When the axle 21C is being inserted into the dial's bearing 15 during assembly, the free end of the axle quadrant 21D is forced to flex inward towards the central axis of the axle 21C as the axle's beveled rim 21E slides through bearing 15. This flexing occurs because the outside radius of the axle's beveled rim 21E is approximately 0.020" larger than the internal radius of bearing 15. Once assembly is complete and the beveled rim 21E has passed completely through bearing 15, the axle quadrant 21D snaps back to its original, unflexed shape, like its shape in FIG. 7. Thereafter the axle's beveled rim 21E prevents the dial's bearing 15 from readily slipping off the axle 21C, since the rim's outside radius is larger than the bearing's internal radius. The dial 10 is mounted such that the flat front face 103 of its annular wall 16 is virtually contiguous with the hub's front disk 21N and such that the flat face 104 of the hub's annular wall 21B is virtually contiguous with the dial's front surface/face 19. The dial's annular wall 16 fits inside the hub's annular wall 21B, with a gap of approximately 0.005" between the two coaxial walls. The hub 21 also includes a stationary ratchet wheel 21L which is coaxial with the axle 21C, as shown in FIG. 5 and FIG. 6. This ratchet wheel 21L protrudes perpendicularly from the hub's disk 21N and is rigidly attached to this disk 21N. This ratchet wheel 21L comprises twenty one radially disposed teeth 21A which are equiangularly spaced around ratchet wheel 21L. The radial angle between adjacent ratchet wheel teeth 21A is equal to the radial angle between adjacent finger holes 11 in dial 10. The faces of teeth 21A are perpendicular to the hub's disk 21N. These ratchet wheel teeth 21A are approximately the same size and same shape as the pawl tooth 14 shown in FIG. 2, FIG. 3, and FIG. 4. The pawl tooth 14 and pawl arm 13 are disposed within dial 10 such that pawl tooth 14 engages these ratchet wheel teeth 21A. During rotation of dial 10, the dial's pawl arm 13 flexes as the pawl tooth 14 travels around the hub's ratchet wheel 21L. As arm 13 flexes, it exerts centripetal force on the pawl tooth 14, since this flexible arm 13 acts as a leaf spring. This centripetal force continuously presses the pawl tooth 14 against ratchet wheel teeth 21A. Unless sufficient rotary force is applied to the dial 10, the centripetal force wedges pawl tooth 14 between two adjacent ratchet wheel teeth 21A until pawl tooth 14 is centered between them. The dial's pawl/detent and the hub's ratchet wheel 21L together constitute a bidirectional ratchet mechanism which retains the dial 10 in a discrete rotary position until sufficient manual force rotates the dial 10 to another discrete rotary position. The discrete rotary positions of dial 10 are determined by the ratchet wheel teeth 21A. It should be noted that bidirectional rotation of the pawl/detent around the ratchet wheel 21L is possible because each ratchet wheel tooth 21A has faces which are symmetrically inclined, as are the faces of the pawl tooth 14.

Figure 8:
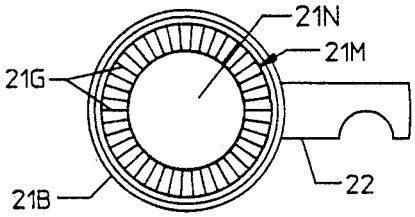
FIG. 8 shows a rear view of a hub with a second embodiment of a ratchet wheel (ratchet wheel 21M) integrated into this hub.
Figure 9:
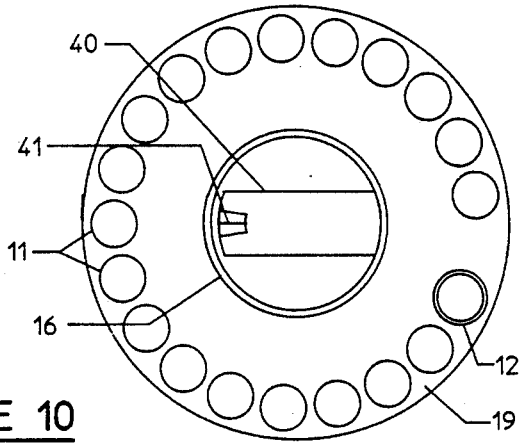
FIG. 9 shows a front view of a dial with a second embodiment of a pawl (pawl tooth 41 and pawl arm 40) attached.
Figure 10:
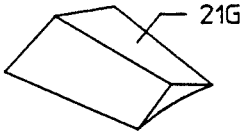
FIG. 10 shows an enlarged perspective view of one of the teeth 21G of ratchet wheel 21M.

FIG. 8, FIG. 9, and FIG. 10 show a second embodiment of a ratchet mechanism incorporated into the register's dial and hub. As shown in FIG. 8, the hub has a stationary ratchet wheel 21M rigidly attached to the hub's disk 21N, coaxial with the hub's annular wall 21B. Ratchet wheel 21M comprises twenty one teeth 21G which are aligned differently than the teeth 21A of the first ratchet wheel embodiment shown in FIG. 5. The edge where the two inclined faces of each tooth 21G intersect is parallel to the hub's disk 21N, whereas the edge where the two inclined faces of each tooth 21A intersect is perpendicular to the hub's disk 21N. Ratchet wheel 21M is designed to engage a second embodiment of a pawl flexibly attached to the dial. As shown in FIG. 9, this second embodiment of the pawl comprises a pawl arm/leaf spring 40 with a pawl tooth 41 disposed at the pawl arm's free end. This pawl arm 40 is simply a straight, flexible beam. The opposite end of pawl arm 40 is attached to the dial's annular wall 16. The shape and size of the pawl's tooth 41 and ratchet wheel's teeth 21G are identical. The faces of each tooth 21G are symmetrically inclined (as shown in FIG. 10) and engage the faces of the pawl's tooth 41 as the pawl tooth 41 travels circumferentially around ratchet wheel 21M during dial rotation. Thus these teeth are suitably configured for bidirectional rotation. When the pawl tooth 41 engages the ratchet wheel teeth 21G, the pawl arm/leaf spring 40 flexes and thereby exerts a spring force on pawl tooth 41. This force continuously maintains contact between pawl tooth 41 and the ratchet wheel teeth 21G during dial rotation, and this force prevents dial rotation except when sufficient rotary force is manually applied to the dial. This second embodiment of the ratchet mechanism basically functions similarly to the first embodiment of the ratchet mechanism, although they are structurally different.

The embodiment of hub shown in FIG. 8 does not have an axle attached to the hub's disk 21N, unlike the hub embodiment shown in FIG. 5 which has axle 21C attached. Instead the annular wall 21B of the hub shown in FIG. 8 functions as a simple bearing for the annular wall 16 of the dial embodiment shown in FIG. 9. The dial's annular wall 16 fits inside the hub's annular wall 21B and functions as a simple axle for the dial. There is a small gap of 0.001" to 0.010" between these two annular walls so that the dial can rotate with its axis of rotation in a substantially fixed position coaxial with the hub.

FIG. 13 shows another embodiment of the dial register. In this embodiment the dial's base includes a flat base plate 90, an arm 52, a hub 120 having a disk 50 with figures/numerals 51 disposed on this disk's front surface, and an axle for the dial (not shown in FIG. 13). This embodiment includes a rotary dial/disk 110 having a manipulable front surface/face 60 with a set of twenty concave dimples 61 disposed in dial surface 60 equidistant from the dial's axis of rotation and equiangularly spaced around this axis. This dial 110 is between 3" and 6" in diameter. The dimples 61 are all equal in size and shape, and they are suitably configured for fingertip rotation of the dial 110. The dimples' common diameter is between 0.25" and 0.60", and the radius of curvature of each dimple's concave surface is similar to the radius of curvature of a human fingertip's surface, whereby each dimple 61 is a suitable fingerhold. The radial angle between adjacent dimples 61 is approximately 16.4 degrees, which is identical to the radial angle between adjacent figures/numerals 51 printed on the front surface of the hub's disk 50. The front surface of hub disk 50 is a base surface for numerals 51. Like the numerals 33 shown in FIG. 1, these numerals 51 represent a mathematical sequence of numbers disposed on an invisible common circumference in sequential order. The arithmetical difference between every pair of adjacent consecutive numerals 51 is equal, and zero is the mathematically smallest number in this sequence. This common circumference is coaxial with the dial 110 and is in close proximity with (less than 0.4" from) the dimples 61. A finger stop/support arm 52 is rigidly attached to the front of hub disk 50 to retain the hub 120 in a fixed position, and this arm 52 has a shoulder 91 which is rigidly attached to a flat base plate 90. Arm 52 extends across a portion of dial surface 60, very close to and parallel with this surface 60. The semicircular notch 53 in this arm 52 is disposed in close proximity to (less than 0.1" from) the dial's annular row of dimples 61, whereby whereby this notched portion of arm 52 is a finger stop for the dial. This notch 53 is disposed near the numeral "0", which is closer to notch 53 than the other numerals 51 are. Like notch 23 in arm 22 (shown in FIG. 1), the distance from the center of notch 53 to the dial's axis of rotation is equal to the distance from the center of each fingerhold (dimple 61) to the dial's axis of rotation. The diameter of notch 53 is between 5% and 25% larger than the diameter of each dimple 61. Dial surface 60 has a hole 63 which is approximately the same diameter as each dimple 61. The distance from the center of this hole 63 to the dial's axis of rotation is equal to the distance from the center of each dimple 61 to this axis, and the radial angle between each pair of adjacent dimples 61 is equal to the radial angle between this hole 63 and the closest dimple 61 adjacent to it. Like the annular rim 12 of dial 10 shown in FIG. 1, hole 63 is a visually distinctive feature of the dial 110 which functions as a scale pointer similar to an indicator hand of an analog meter's display. This hole 63 is near (less than 0.4" from) the invisible circumference where the numerals 51 are disposed, and this hole 63 highlights whichever numeral 51 is closest to it when the dial 110 is stationary. Thus this hole 63 functions as a scale pointer operatively associated with a numeric scale comprising the set of numerals 51. As shown in FIG. 13, hole 63 is highlighting the numeral "40". The rotary position of the dial 110 determines which numeral 51 is highlighted by hole 63, because hole 63 travels circumferentially around the numerals 51 during dial rotation. It should be noted that although this embodiment of the dial register is not incorporated into a diet guidebook containing relevant food data, this embodiment nonetheless can function as a register for monitoring consumption of a food parameter because some food parameters such as calories are commonly listed on a food's packaging.

Figure 11:
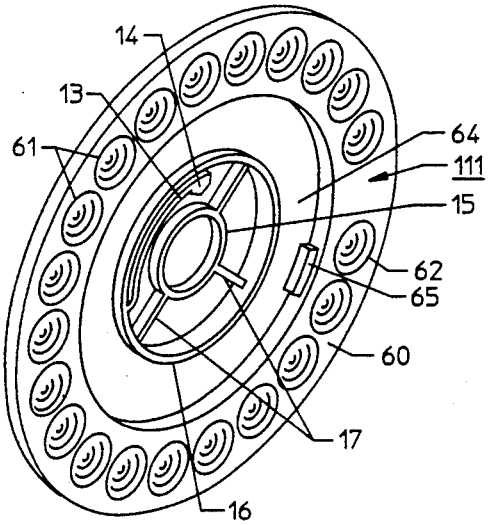
FIG. 11 shows a perspective front view of the prefered embodiment of the rotary dial (dial 111).

FIGS. 11, 12, 14, 15, 16, and 17 show components of the prefered embodiment of the dial register. Like the dial 110 shown in FIG. 13, the dial/disk 111 shown in FIGS. 11, 14, and 15 includes a manipulable front dial surface 60 having an annular row of concave dimples 61 which are equidistant from the dial's axis of rotation. The dimensions of this dial 111 are similar to the dimensions of the dial 110 shown in FIG. 13. Like the dial 10 shown in FIG. 1, FIG. 2, and FIG. 3, this dial 111 also includes a curved pawl arm 13, a pawl tooth 14, a simple annular bearing 15 with ribs 17 radially attached, and an annular wall 16. The configuration of these dial 111 subcomponents shown in FIGS. 11 and 15 is quite similar to the configuration of dial 10 subcomponents shown in FIGS. 2 and 3. All the dial's subcomponents are injection molded simultaneously as one integrated plastic piecepart. Unlike dial 10, the annular wall 16 of dial 111 is disposed in a recessed portion 64 of the dial's body. This recessed portion 64, the annular bearing 15, and the annular wall 16 are all coaxial with the dial's axis of rotation, as shown in FIG. 15. A first rotary stop 65 is disposed at the perimeter of the recessed portion 64 of the dial's body, adjacent to dimple 62. This first rotary stop 65 is a rib protruding from the dial's body, as shown in FIGS. 11 and 15. This first rotary stop 65 rotates with dial 111 along a circumferential path which is coaxial with the dial's axis of rotation. Unlike the other dial embodiments, the rotary dial 111 shown in FIGS. 11, 14, and 15 has a distinctively colored dimple 62 disposed in the dial's front surface 60. The position of this dimple 62 relative to the other dimples 61 in this dial 111 is identical to the position of hole 63 relative to the dimples 61 of dial 110 shown in FIG. 13. Dimple 62 is coated with a paint or dye whereby the color of dimple 62 is distinctively different than the color of dial surface 60. The paint/dye on the surface of dimple 62 forms a distinctively colored dot on dial 111 which functions as a scale pointer, similar in function to hole 63 in dial 110 shown in FIG. 13. The diameter of this dot is similar to the diameter of each dimple 61, which is significantly smaller than the dial's outer diameter.

Figure 12:
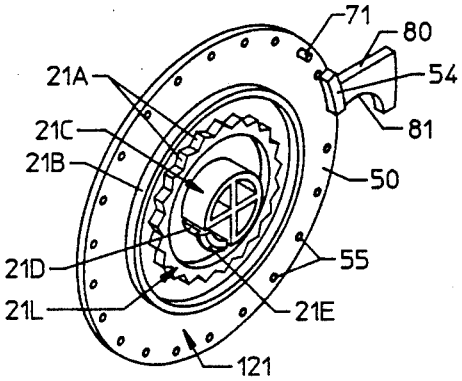
FIG. 12 shows a perspective rear view of the prefered embodiment of the means for rotatably mounting the dial, which comprises hub 121, axle 21C, and arm 80.

The hub 121 shown in FIGS. 12, 14, and 16 is similar to the hub 120 shown in FIG. 13. Both hub embodiments include a hub disk 50, which is stationary, and sequential figures/numerals 51 disposed on an invisible common circumference in consecutive order on the front surface of disk 50. The radial angle between each pair of adjacent numerals 51 is approximately 16.4 degrees and is equal to the radial angle between each pair of adjacent dimples 61 on the dial's front surface 60, as shown in FIG. 14. The front surface of hub disk 50 is a base surface for numerals 51. Like hub 21 shown in FIGS. 5 and 6, the hub 121 shown in FIGS. 12 and 16 includes an annular wall 21B, and this annular wall 21B and a ratchet wheel 21L and an axle 21C are rigidly attached to and coaxial with the hub's disk 50. Ratchet wheel 21L comprises twenty two ratchet teeth 21A equiangularly spaced around its perimeter. The configuration of the ratchet wheel 21L and the axle 21C shown in FIGS. 12 and 16 is essentially identical to the configuration of the ratchet wheel 21L and the axle 21C shown in FIG. 5. Unlike hub disk 21N shown in FIG. 5, the outer diameter of hub disk 50 is larger than the outer diameter of the hub's annular wall 21B, as shown in FIGS. 12 and 16. In both the embodiment shown in FIG. 13 and the embodiment shown in FIG. 14, the front face of the hub's disk 50 is coplanar with the dial's front surface/face 60, and there is a gap of 0.001"–0.020" between the perimeter of the hub's disk 50 and the inner circumferential boundary of the dial's front surface 60. The hub's annular wall 21B shown in FIGS. 12 and 16 fits around the dial's annular wall 16 shown in FIGS. 11 and 15, with a gap of 0.001"–0.020" between these two coaxial annular walls, and the pawl tooth 14 shown in FIGS. 11 and 15 engages the ratchet wheel teeth 21A shown in FIGS. 12 and 16, when the dial 111 and hub 121 are assembled as shown in FIG. 14. The annular bearing 15 shown in FIGS. 11 and 15 rotatably engages the axle 21C shown in FIGS. 12 and 16, similar to the axle and bearing configuration of the dial register's first embodiment. The hub 121 shown in FIGS. 12, 14, and 16 has a finger stop/support arm 80 rigidly attached to the front of hub disk 50. This arm 80 is similar to arm 52, shown in FIG. 13, except that the outer end 80A of arm 80 is rigidly attached to an annular wall of a molded casing (not shown). The prefered embodiment's molded casing is identical to casing 20, shown in FIG. 1, and arm 80 is attached to the annular wall of the prefered embodiment's casing in the same configuration as arm 22 is attached to annular wall 24 of casing 20. Arm 80 extends across a portion of dial surface 60, very close to and parallel with surface 60. Arm 80 has a semicircular notch 81 which is disposed in the same position relative to the dimples 61 as the notch 53 of arm 52 (shown in FIG. 13) is disposed. The hub's disk 50 has a rotary stop 54 protruding perpendicularly from this disk's rear face, adjacent to arm 80 at the perimeter of disk 50, as shown in FIGS. 12 and 16. This second rotary stop 54 is a rib similar to the first rotary stop 65. This second rotary stop 54 is disposed in a fixed, stationary position within the circumferential path of the first rotary stop 65, whereby this second rotary stop 54 limits the circumferential travel of the first rotary stop 65. The combination of the first rotary stop 65 and the second rotary stop 54 limits the maximum rotary travel of the dial 111 such that the dial 111 cannot be rotated more than one revolution. The second rotary stop 54 is disposed in a position which blocks clockwise circumferential travel of the first rotary stop 65 when the dial's distinctively colored dimple 62 is adjacent to the finger stop's notch 81, whereby clockwise rotary force applied to dial 111 cannot rotate the dial 111 when dimple 62 is adjacent to notch 81 although the dial 111 can be rotated counterclockwise. Hub disk 50 includes twenty one small holes 55 which are equidistant from the dial's axis of rotation and equiangularly spaced around this axis. Each hole 55 is disposed adjacent to a numeral 51, close to the perimeter of hub disk 50, as shown in FIG. 14 and FIG. 16. The diameters of these holes 55 are all equal. The radial angle between each pair of adjacent holes 55 is equal to the radial angle between each pair of adjacent numerals 51. The axis of each hole 55 is parallel to the dial's axis of rotation and is perpendicular to the front face of hub disk 50.

All the components shown in FIGS. 12 and 16, together with a casing (such as casing 20 shown in FIG. 1), are injection molded as one integrated plastic piece-part, in order to minimize the number of discrete parts which must be assembled together. Thus all the subcomponents which constitute the means for rotatably mounting the dial 111 are integrated into a molded plastic casing. This casing is attached to a hardbound book cover, identical to the configuration of casing 20 and book cover 32 shown in FIG. 1, and this casing and book cover together constitute a base for dial 111.

The dial register embodiment shown in FIG. 14 includes a movable peg 70. As shown in FIG. 17, this peg 70 has a rigid cylindrical shaft 71 and a spherical head 72 rigidly attached to one end of shaft 71. The peg's shaft 71 fits snugly into any of the holes 55 in the hub's disk 50. Any of the holes 55 can retain the peg's shaft 71 in a temporarily fixed position, and peg 70 can be manually removed from one hole 55 and then mounted into another hole 55. The diameter of the leg's spherical head 72 is bigger than the diameter of each hole 55, whereby the leg's spherical head 72 cannot pass through any hole 55. The peg 70 is mounted in a disk hole 55 with its spherical head 72 disposed in front of hub disk 50 and with its shaft 71 extending beyond the rear face of hub disk 50. Each of the disk holes 55 is disposed such that when the leg's shaft 71 extends through a hole 55, the end of shaft 71 is within the circumferential path of the first rotary stop 65, whereby this peg 70 limits the circumferential travel of the first rotary stop 65. The combination of first rotary stop 65 and movable peg 70 limits the maximum rotary travel of the dial 111. Thus peg 70 is a variable position rotary stop, and the set of holes 55 in hub disk 50 is a means for mechanically coupling this peg 70 to hub disk 50 in a temporarily fixed, manually resetable position within the circumferential path of the first rotary stop 65.

FIG. 18 shows an alternative embodiment of the register's dial and hub which is very similar to the prefered embodiment shown in FIGS. 11, 12, 14, 15, and 16. The only differences between the alternative embodiment shown in FIG. 18 and the prefered embodiment are the orientation of the figures/numerals 56 on hub disk 50, the indicator hand 66 attached to the dial's front surface 60, the absence of holes 55 in hub disk 50, and the absence of peg 70. Unlike numerals 51 in the prefered embodiment shown in FIG. 14, the longitudinal axis of every numeral 56 is not vertical. Instead the longitudinal axis of each numeral 56 is disposed on an invisible radius of hub disk 50; the numerals 56 are radially oriented on hub disk 50, as shown in FIG. 18. Like the numerals 51 in the prefered embodiment, the numerals 56 are equidistant from the dial's axis of rotation and are equiangularly spaced around this axis in sequential order. Unlike adjacent numerals 51, the arithmetical difference between adjacent numerals 56 is one, because the sequence of numerals 56 disposed on hub 122 comprises all integers between 0 and 20 inclusive. The dial 112 shown in FIG. 18 does not include a distinctively colored dimple 62 in the dial's front surface 60, unlike the prefered embodiment shown in FIGS. 11, 14, and 15. Instead the dial 112 shown in FIG. 18 includes a indicator hand 66 rigidly attached to the front surface 60 of the dial 112. Like the distinctively colored dimple 62, indicator hand 66 is a scale pointer that highlights whichever numeral 56 is closest to indicator hand 66. During dial rotation this indicator hand 66 travels along a circumferential path adjacent to the annular row of numerals 56.

In addition to the embodiments shown in FIGS. 1–18, a variety of other embodiments of the present invention are possible. Alternative materials besides plastic can be used in the components, and alternative forms of the components can be used in functionally equivalent embodiments of the present invention.

One alternative embodiment comprises a flat cardboard disk which is rotatably mounted, via a grommet, onto the interior face of a book's cover. This disk has an annular row of finger holes, similar to some of the other embodiments of the rotary dial. A set of sequential numerals is printed on the interior face of the book's cover, equidistant from the disk's axis of rotation, disposed similar to the numerals in the first embodiment shown in FIG. 1. The scale pointer in this alternative embodiment is some visually distinctive indicia printed on the disk near one of the holes, such as a distinctively colored annulus printed on the disk around one finger hole. This alternative embodiment does not include a finger stop, which is a convenient but nonessential component of the invention. If a person operating the disk remembers to stop rotating the disk once his index finger tip is nearest to the numeral 0, the register can function properly without a finger stop to prevent excessive rotation. An important advantage resulting from the simplicity of this embodiment is its exceptionally low manufacturing cost.

A second alternative embodiment not shown in the figures comprises all the components of the first alternative embodiment, wherein the cardboard disk additionally has an annular row of sequential numerals printed thereon, and wherein the book's cover additionally has a small window/opening through which one of the numerals on the disk is visible when viewed from the exterior side of the book's cover. The annular row of numerals on the disk rotates with the disk, unlike the set of numerals printed on the book's cover. This annular row of numerals and the scale pointer indicia are printed on opposite faces of the cardboard disk. The numerals printed on the disk are identical to the numerals printed on the book's cover. The numerals on the disk, the scale pointer indicia on the disk, the window/opening in the book's cover, and the numerals on the book's cover are disposed in positions such that whichever numeral on the disk is visible in the window/opening is mathematically equal to whichever numeral on the book's cover is nearest to the scale pointer indicia on the disk. This embodiment is advantageous because the window/opening with the numerals on the disk behind it permit a person to view the appropriate food parameter value when the book is closed, unlike the previously described embodiments. The appropriate food parameter value which is visible in this window/opening represents a maximum quantity of some food parameter, such as grams of fat, which a person may consume during the remainder of the day. Each time the person rotates the disk after eating, the numeral which is visible in this window/opening decreases mathematically, and once the numeral in this window/opening is the numeral 0, the person should stop consuming foods which contain significant quantities of the appropriate food parameter.

A third alternative embodiment which is not shown in the figures is a register similar to the prefered embodiment which additionally includes a second manually operable rotary dial coaxial with the first dial. The front faces of both dials are substantially coplanar, and the second dial's front face is a flat annulus which fits around the perimeter of the first dial. This second dial's front face has finger holes or dimples which are equidistant from the dials' common axis of rotation, in an annular row. A second scale pointer is coupled to the second dial such that this scale pointer rotates with the second dial. The two dials rotate independently: when one dial is manually rotated, the other dial does not rotate. A second set of sequential numerals is printed on the base, near the second dial's annular row of finger holes or dimples. These numerals are equidistant from the dials' axis of rotation, and they represent values of a second food parameter. The second scale pointer rotates in close proximity to the second set of numerals, in order to indicate the maximum quantity of this second food parameter which a person may consume during the remainder of the day. This third alternative embodiment is advantageous because it can simultaneously monitor a person's consumption of two different food parameters, such as total calories and grams of fat, unlike the other embodiments.

As shown in the drawings, each set of figures representing numbers from a sequence comprises Arabic numerals, but other embodiments of this set of figures are possible. Essentially the set of figures is a display scale which comprises any indicia representing a mathematical sequence of numbers. This set of figures could comprise Roman numerals or alphabetical letters in consecutive order, for example. Alternatively this set of figures could comprise small dots or asterisks equiangularly spaced in an annular row, wherein the position of a particular dot or asterisk, relative to the position of the finger stop, indicates which number the particular dot or asterisk represents. For example, if each pair of adjacent dots represents a pair of numbers with an arithmetical difference of 2, then the dot closest to the finger stop represents the number 0, and the second closest dot represents the number 2, and the third closest dot represents the number 4, etcetera. Although each set of figures shown in the drawings includes the numeral 0, alternative embodiments without a figure representing the number 0 are also possible, because the number 0 can be infered by a person when the scale pointer is closest to the finger stop. Any embodiment of the set of figures could be embossed on the surface of the base or could be printed directly on the base or could be printed on a label which is affixed onto the base.

Although the description of prefered embodiments focusses primarily on registers for monitoring consumption of a food parameter, the present register can be used for monitoring some other parameter, such as the cumulative number of calories burned by a person's body during exercises. In embodiments of such a register which include a book, the book may include data related to the parameter being monitored.

Alternatively the present register can be used as a calculator for subtraction or addition of numbers. Embodiments similar to the embodiment shown in FIG. 13 are suitable for successive subtraction of numbers, for example. In embodiments of such a calculator which include a book, the book may include instructions on operating the calculator, and the book may provide a housing for the calculator.

The present invention alternatively can be used as a register for monitoring a game score, because the invention registers an accumulation of quantities up to a target quantity. Such a register is suitable for keeping score in some games. Embodiments of the register which are not incorporated into books, such as the embodiment shown in FIG. 13, are appropriate for game counters/scorekeeper devices.

OPERATION OF THE INVENTION

The basic operation of each embodiment of the present invention shown in FIGS. 1–18 is identical. The diet guidebook 30 includes information about recommended target quantities of the food parameter being monitored by the users. The target quantity for a user is the recommended maximum or minimum quantity of this parameter which the user should cumulatively consume during one day. The target quantity for a particular user depends on the user's ideal body weight, and possibly other factors such as sex. Target quantities for users with different ideal body weights are listed in a table printed on a page (not shown) of diet guidebook 30. This table has one columnar list of ideal body weights and has an adjacent columnar list of recommended target quantities. The user determines his own target quantity by finding his ideal body weight in the former column and then by finding the target quantity which is listed horizontally adjacent to his ideal weight in the target quantity list. Once the user has determined his target quantity, in the beginning of the day he places his index fingertip in the dial's finger hole or dimple which is closest to the scale pointer, and then he manually rotates the dial until the scale pointer is adjacent to whichever numeral printed on the register is mathematically most similar to his target quantity. For example, if a person's target quantity is 40 grams of saturated fat and he is using the prefered embodiment shown in FIG. 14, he places his index fingertip in the dial's distinctively colored dimple 62, which is the means for pointing, and he then manually rotates dial 111 until dimple 62 is adjacent to numeral "40" on hub 121 (as shown in FIG. 14). The user does this in order to initially set the register's dial before he consumes any food. The register's ratchet mechanism (e.g., ratchet wheel 21L, pawl tooth 14, and pawl arm 13, shown in FIGS. 11, 12, 15, and 16) retains the dial in this initial position until the user manually rotates the dial to a new position. Each time the user consumes a food item, the user looks in the diet guidebook's list 37 of quantities of the food parameter to determine the quantity of the food parameter in that food item. The user then registers his consumption of this quantity: He places his index fingertip in the dial's finger hole or dimple adjacent to the numeral printed on the register which is mathematically most similar to this quantity, and he then rotates the dial clockwise with his index finger until his index finger is stopped by the register's finger stop, adjacent to the numeral "0". For example, if a person consumes a food containing 6 grams of saturated fat and he is using the prefered embodiment shown in FIG. 14, he places his index fingertip in the dial's dimple 61 which is adjacent to the numeral "6" on hub 121, and he then rotates dial 111 clockwise with his index fingertip until his index finger is stopped by the notched portion of arm 80, adjacent to the numeral "0". The register's ratchet mechanism then retains the dial in this new position until the user manually rotates the dial again to register his consumption of another quantity of the food parameter. Each time the user rotates the dial clockwise, the scale pointer moves circumferentially towards the numeral "0" printed on the register. The position of this scale pointer indicates how close the user's cumulative consumption of the food parameter is to the user's target quantity. The distance measured circumferentially between the numeral adjacent to the scale pointer and the numeral "0" is proportional to the arithmetical difference between the user's target quantity and the user's cumulative consumption of the food parameter at any given time. The numeral printed on the register which is adjacent to the scale pointer represents the arithmetical difference between the user's target quantity and the user's cumulative consumption of the food parameter at any given time. When the scale pointer is adjacent to the numeral "0" on the register, the scale pointer indicates that the user's cumulative consumption of the food parameter equals the user's target quantity. If the user's target quantity is his maximum recommended quantity of a food parameter, such as saturated fat grams, then the register'scale pointer indicates that the user should stop consuming foods which contain this parameter once the scale pointer is adjacent to the numeral "0" printed on the register. The user manually rotates the dial each time he eats a food item which contains the parameter, in order to register his consumption of the food parameter, and he may continue to eat foods which contain this food parameter until the scale pointer is adjacent to the numeral "0" printed on the register. If the user's target quantity is his minimum recommended quantity of some food parameter, such as dietary fiber, the user should continue eating foods containing this food parameter while registering his consumption of this food parameter until the register's scale pointer is adjacent to the numeral "0" printed on the register, in order to ensure that the user consumes enough of this food parameter.

The prefered embodiment of the register includes a first rotary stop 65, which is rigidly attached to the dial 111, and a second rotary stop 54, which is rigidly attached to the hub 121, as shown in FIGS. 11, 12, 15, and 16. The second rotary stop 54 prevents the first rotary stop 65 from circumferentially travelling clockwise when the dial's distinctively colored dimple 62 is adjacent to the numeral "0" printed on the hub 121. These two rotary stops prevent the dial 111 from being rotated clockwise when dimple 62, which is the scale pointer, is adjacent to the the numeral "0". Thus once the means for pointing is adjacent to the numeral "0" printed on the register, the user cannot rotate the dial clockwise to register more consumption of the food parameter. The register thereby reminds the user that his cumulative consumption of the food parameter equals his target quantity when he cannot rotate the dial clockwise any further. If the user's target quantity is his maximum recommended quantity of a food parameter, the user should stop consuming foods which contain this parameter when he cannot rotate the dial clockwise any further.

The prefered embodiment of the register includes a movable peg 70 with a shaft 71 that is retained in one of the holes 55 of hub 121, as shown in FIG. 14. Once the user has determined his target quantity, he inserts the peg's shaft 71 into the hole 55 nearest whichever numeral 51 on hub 121 is mathematically most similar to his target quantity. For example, if the user's target quantity is 40 grams of saturated fat, the user inserts the peg's shaft 71 into the hole 55 adjacent to the numeral "40". This peg 70 is inserted into the appropriate hole 55 before the user initially sets the dial 111. The spherical head 72 of peg 70 marks the location where the dial's distinctively colored dimple 62 should be positioned when the user initially sets the dial 111, prior to consuming food. Once the user has inserted the peg 70 into the appropriate hole 55, he initially sets dial 111 by manually rotating dial 111 until dimple 62 is adjacent to peg 70, as shown in FIG. 14. The position of this peg 70 remains fixed unless the user's target quantity changes; the user only inserts this peg 70 into a new hole 55 if his target quantity changes. The end of the peg's shaft 71 is disposed within the circumferential path of the dial's rotary stop 65, once the user has inserted peg 70 into the appropriate hole 55 of hub 121. The combination of the first rotary stop 65 and peg 70 limits the maximum rotary travel of the dial 111 such that when the dial's dimple 62 is adjacent to peg 70, as shown in FIG. 14, the dial 111 cannot be rotated counterclockwise. Because the dial's rotary stop 65 is disposed adjacent to the dial's dimple 62, as shown in FIG. 15, the end of the peg's shaft 71 blocks counterclockwise travel of rotary stop 65 when dimple 62 is adjacent to peg 70. When dimple 62 is in this position, the dial 111 can only be rotated clockwise. Once peg 70 has been inserted into the appropriate hole 55 of hub 121, the user can initially set the dial 111 by simply rotating dial 111 counterclockwise until peg 70 stops further rotation, whereupon the dial's dimple 62 is adjacent to peg 70. Thus the user does not need to remember his target quantity in order to initially set the dial each day, which is convenient.

The present invention performs successive subtraction operations when the user periodically rotates the register's dial clockwise during the day. Once the user has initially set the dial so that the scale pointer is adjacent to his target quantity numeral, the scale pointer is at a target distance from an origin location. This target distance is measured along the invisible circumference of the printed numerals, in the counterclockwise direction, from the origin location to the scale pointer position, and this target distance equals a proportionality constant times the user's target quantity. This origin location is the region where the numeral "0" is printed on the register's base. Each numeral printed on the register's base equals the circumferential distance of the numeral from the origin location divided by the proportionality constant. Each time the user registers his consumption of a food parameter quantity by rotating the dial clockwise, the scale pointer moves circumferentially towards the origin location a circumferential quantity distance equal to the proportionality constant times the food parameter quantity. For example, if the user wants to register his consumption of 6 grams of fat, he would place his index fingertip in the dial's dimple or hole adjacent to the numeral "6", and then he would rotate the dial clockwise until his index finger reaches the register's finger stop. If the register's proportionality constant is 0.10" per gram of fat, this dial rotation would move the register's scale pointer 0.60" circumferentially towards the numeral "0". This dial rotation would subtract, 0.0.60" from the circumferential distance between the scale pointer and the origin location, and the numeral which is highlighted by (i.e., adjacent to) the scale pointer after this dial rotation would equal the previously highlighted numeral minus 6. Each time the user manually rotates the dial clockwise, the register performs a subtraction operation, and after rotation the scale pointer highlights the numeral which represents the result of the subtraction operation. The numeral which is highlighted becomes the minuend of the next subtraction operation when the dial is next rotated clockwise. In the beginning of the day, the user's target quantity is the minuend of the first subtraction operation. The register performs successive subtraction operations during the day until the scale pointer is adjacent to the numeral "0", at the origin location. The scale pointer is adjacent to the numeral "0" once the accumulation of food parameter quantities equals the user's target quantity. Thus the unique configuration of the present invention's dial, scale pointer, set of numerals, and base provide a simple means for performing arithmetical calculations.

Although various embodiments of the present invention have been specifically described in the preceding paragraphs, the invention is not to be limited to the preceding descriptions. Many other embodiments may be evident to one skilled in the art, and all embodiments are intended to be encompassed in the present invention as defined in the following claims.

I claim:

1. A register comprising:

manually operable rotary dial having a manipulable dial surface;

base for said dial, including means for rotatably mounting said dial to said base, whereby said dial is mounted to rotate abut an axis of rotation;

finger stop which is attached to said base in a stationary position in close proximity to said dial surface such that said finger stop limits the maximum rotary travel of a finger rotating said dial;

set of numerals representing a mathematical sequence of numbers, wherein the individual numerals in said set of numerals are disposed on said base approximately equidistant from said axis of rotation and approximately equiangularly spaced around said axis of rotation in consecutive order; and a scale pointer permanently coupled with said dial in close proximity to said set of numerals, wherein said scale pointer rotates along with said dial and highlights the numeral in said set of numerals which is closest to said scale pointer, whereby said scale pointer and said set of numerals in combination function as a simple numeric display;

wherein said dial is disposed such that said dial surface is accessible for manual rotation of said dial, and wherein said set of numerals and said scale pointer and said dial are disposed in positions such that said set of numerals and said scale pointer and said dial surface are all viewable.

2. The apparatus described in claim 1, wherein said dial includes a set of simples disposed on said dial surface approximately equidistant from said axis of rotation and approximately equiangularly spaced around said axis of rotation, and wherein each of the dimples in said set of dimples is a fingerhold operatively configured for fingertip rotation o said dial, and wherein said set of numerals is disposed on said base in close proximity to said set of dimples.

3. The apparatus described in claim 1, wherein said dial includes a set of holes disposed on said dial surface approximately equidistant from said axis of rotation and approximately equiangularly spaced around said axis of rotation, and wherein each of the holes in said set of holes is a fingerhold operatively configured for fingertip rotation of said dial, and wherein said set of numerals is disposed on said base in close proximity to said set of holes.

4. The apparatus described in claim 1, wherein said scale pointer comprises indicia on said dial in close proximity to said set of numerals.

5. The apparatus described in claim 4, wherein said indicia comprises a distinctively colored dot which is significantly smaller than said dial.

6. The apparatus described in claim 1, wherein said scale pointer comprises an indicator hand permanently attached to said dial, and wherein at least a portion of said indicator hand is disposed in close proximity to said set of numerals.

7. The apparatus described in claim 1, wherein said scale pointer comprises a visually distinctive element disposed on said dial in close proximity to said set of numerals.

8. Apparatus described in claim 1, wherein said means for rotatably mounting said dial includes an axle for said dial and a hub coupled to said axle such that said axle and said hub together retain said dial, and wherein said hub is anchored in a fixed position and does not rotate, and wherein said dial and said axle and said hub are all coaxial with said axis of rotation.

9. Apparatus described in claim 8, wherein said set of numerals is disposed on said hub, in close proximity to said manipulable dial surface.

10. Apparatus described in claim 1, wherein said base includes a plastic casing which partially encloses said dial, and wherein said plastic casing includes a wall and includes said means for rotatably mounting said dial, and wherein said means for rotatably mounting said dial includes an axle for said dial, a hub coupled to said axle such that said axle and said hub together retain said dial, and a support arm rigidly attached to said hub and to said wall of said plastic casing such that said hub is anchored in a fixed position and does not rotate.

11. Apparatus described in claim 1, wherein said base for said dial includes a base plate having a substantially flat surface on which said dial is rotatably mounted such that said axis of rotation is substantially perpendicular to said flat surface, and wherein said base plate comprises a book cover which is flexibly attached along an edge to a book spine bound to a set of pages of a book, and wherein said flat surface is a cover surface which faces towards said set of pages when said book is in a closed position, and wherein said manipulable dial surface faces towards said set of pages when said book is in said closed position, and wherein said dial is enclosed within said book when said book is in said closed position, whereby said book provides a housing for said dial, and wherein said manipulable dial surface is accessible for manual rotation when said cover surface is facing away from said set of pages, and wherein text useful for operating said apparatus is printed in said set of pages.

12. Apparatus described in claim 11, wherein said set of numerals is printed on said cover surface, in close proximity to said manipulable dial surface.

13. Apparatus described in claim 1, wherein the mathematically smallest numeral in said set of numerals is a zero, and wherein said mathematically smallest numeral is disposed on said base in close proximity to said finger stop, and wherein the arithmetical difference between every pair of consecutive numerals in said set of numerals is equal, and wherein said set of numerals is disposed on said base in close proximity to said manipulable dial surface.

14. Apparatus described in claim 1, which further includes rotary stop means for limiting the maximum rotary travel of said rotary dial.

15. Apparatus described in claim 14, wherein said rotary stop means includes a first rotary stop permanently attached to said rotary dial and includes a second rotary stop permanently attached to said base, and wherein said first rotary stop rotates with said rotary dial along a circumferential path, and wherein said second rotary stop is disposed in a stationary position within said circumferential path of said first rotary stop such that said second rotary stop blocks the rotation of said rotary dial in one direction when said scale pointer is closest to said finger stop.

16. Apparatus described in claim 14, wherein said rotary stop means includes:

a first rotary stop permanently attached to said rotary dial, wherein said first rotary stop rotates with said rotary dial along a circumferential path;

a variable position rotary stops; and a means for coupling said variable position rotary stop to said base in a temporarily fixed, manually resetable position within said circumferential path of said first rotary stop such that said variable position rotary stop limits the circumferential travel of said first rotary stop.

17. Apparatus described in claim 16, wherein said variable position rotary stop comprises a peg having a rigid shaft, and wherein said means for coupling said variable position rotary stop comprises a set of holes in said base which are approximately equidistant from said axis of rotation, and wherein each of the holes in said set of holes is operatively configured for retaining said rigid shaft within said circumferential path of said first rotary stop.

18. Apparatus described in claim 1, which further includes bidirectional ratchet means for preventing rotation of said rotary dial except when sufficient rotary force is manually applied to said rotary dial.

19. Apparatus described in claim 18, wherein said bidirectional ratchet means comprises:

a ratchet wheel rigidly attached to said base and coaxial with said axis of rotation and having a set of ratchet wheel teeth radially disposed around said axis of rotation; and a pawl springably attached to said rotary dial, wherein said pawl includes a pawl tooth operatively configured for bidirectional rotation around said set of ratchet wheel teeth, and wherein said pawl tooth operatively engages said set of ratchet wheel teeth.

20. A dial register for monitoring an accumulation of quantities up to a total target quantity, which comprises:

a base having a base surface, wherein said base surface includes a line of figures disposed on a common circumference centered around an axis, wherein each figure in said line of figures represents a number substantially proportional to a unique distance along said common circumference extending in a common direction from said figure to a common origin on said common circumference, and wherein said line of figures comprises numerals which are approximately equidistantly spaced along said line of figures in consecutive order, and wherein one of said numerals in a zero;

a disk mounted to rotate about said axis and having a manipulable disk surface, wherein said disk includes a curved row of fingerholds which are disposed on said disk surface approximately equidistant from said axis in close proximity with said common circumference and which are approximately equidistantly spaced along said curved row of fingerholds and which are operatively configured for fingertip rotation of said disk; and a scale pointer coupled with said disk in close proximity to said common circumference, wherein said scale pointer rotates along with said disk and highlights the figure in said line of figures which is closest to said scale pointer, whereby said scale pointer and said line of figures in combination function as a simple numeric display;

wherein said base includes means for rotatably mounting said disk whereby said disk rotates about said axis, and wherein said disk functions as a rotary dial which a user manually rotates through a partial revolution to register each of the quantities in said accumulation of quantities, and wherein said scale pointer successively highlights a plurality of the figures in said line of figures as said disk is successively rotated manually.

21. Apparatus described in claim 20, which further includes rotary stop means for limiting the maximum rotary travel of said disk.

22. Apparatus described in claim 20, which further includes detent means for preventing rotation of said disk except when sufficient rotary force is manually applied to said disk.

23. Apparatus described in claim 20, wherein said base includes a base plate having a substantially flat surface on which said disk is rotatably mounted such that said axis is substantially perpendicular to said flat surface, and wherein said base plate comprises a book cover which is flexibly attached along an edge to a book spine bound to a set of pages of a book, and wherein said flat surface is a cover surface which faces towards said set of pages when said book is in a closed position, and wherein said manipulable disk surface faces towards said set of pages when said book is in said closed position, and wherein said disk is enclosed within said book when said book is in said closed position, whereby said book provides a housing for said disk, and wherein said manipulable disk surface is accessible for manual rotation when said cover surface is facing away from said set of pages, and wherein data relevant to operation of said dial register is printed in said set of pages.

24. Apparatus described in claim 23, wherein said data comprises:

a printed list of food item descriptions, wherein each of the food item descriptions in said printed list of food item descriptions comprises a printed quantity of a food item disposed adjacent to a printed qualitative description of said food item; and a printed list of approximate numerical values of a food parameter, wherein the approximate numerical value of said food parameter associated with each said food item description is printed adjacent to each said food item description;

and wherein the figures in said line of figures represent sequential values of said food parameter, whereby a user of said apparatus can monitor consumption of said food parameter while eating by manually rotating said disk by an appropriate amount specified in said printed list of approximate numerical values.

25. A dial register for monitoring an accumulation of quantities up to a total target quantity, which comprises:

a base having a base surface, wherein said base surface includes a line of figures disposed on a common circumference centered around an axis, wherein each figure in said line of figures represents a number substantially proportional to a unique distance along said common circumference extending in a common direction from said figure to a common origin on said common circumference;

a disk mounted to rotate about said axis and having a manipulable disk surface in close proximity with said common circumference;

a scale pointer coupled with said disk in close proximity to said common circumference, wherein aid scale pointer rotates along with said disk and highlights the figure in said line of figures which is closest to said scale pointer, whereby said scale pointer and said line of figures in combination function as a simple numeric display; and a finger stop which is attached to said base in a stationary position in close proximity to said common origin and in close proximity to said disk surface such that said finger stop limits rotary travel of a finger rotating said disk;

wherein said base includes means for rotatably mounting said disk whereby said disk rotates about said axis, and wherein said disk functions as a rotary dial which a user manually rotates through a partial revolution to register each of the quantities in said accumulation of quantities, and wherein said scale pointer successively highlights a plurality of the figures in said line of figures as said disk is successively rotated manually.

26. A register comprising:

a manually operable rotary dial having a manipulable dial surface;

a base for said dial, including means for rotatably mounting said dial to said base, whereby said rotary dial is mounted to rotate about an axis of rotation;

a display scale radially disposed around said axis of rotation, wherein said display scale comprises indicia representing a mathematical sequence of numbers disposed on said base approximately equidistant from said axis of rotation;

a scale pointer coupled with said rotary dial in close proximity to said display scale, wherein said scale pointer rotates along with said rotary dial adjacent to said indicia of said display scale, whereby said scale pointer and said display scale in combination function as a simple numeric display; and a finger stop which is attached to said base in a stationary position in close proximity to said dial surface such that said finger stop limits rotary travel of a finger rotating said dial;

wherein said rotary dial is disposed such that said manipulable dial surface is accessible for manual rotation of said rotary dial, and wherein said rotary dial and said display scale and said scale pointer are disposed in positions such that said display scale and said scale pointer and said manipulable dial surface are all viewable.

27. A dial register for monitoring an accumulation of quantities up to a total target quantity, said dial register comprising:

a base having a base surface, wherein said base surface includes a line of figures disposed on a common circumference centered around an axis, wherein each figure in said line of figures represents a number substantially proportional to a unique distance along said common circumference extending in a common direction from said figure to a common origin on said common circumference;

a disk mounted to rotate about said axis and having a manipulable disk surface in close proximity with said common circumference; and a scale pointer coupled with said disk in close proximity to said common circumference, wherein said scale pointer rotates along with said disk and highlights the figure in said line of figures which is closest to said scale pointer, whereby said scale pointer and said line of figures in combination function as a simple numeric display;

wherein said base includes means for rotatably mounting said disk whereby said disk rotates about said axis, and wherein said base includes a stop in a fixed position proximal to said common origin and proximal to said manipulable disk surface whereby said stop limits rotary travel of an object temporarily engaged with said manipulable disk surface during rotation of said disk, and wherein said scale pointer successively highlights a plurality of the figures in said line of figures as said disk is successively rotated.

* * * * *